United States Patent [19]

Henderson

[11] Patent Number: 5,022,617

[45] Date of Patent: Jun. 11, 1991

[54] COLLAPSIBLE VALET

[76] Inventor: Robert M. Henderson, P.O. Box 770, Lamarque, Tex. 77568

[21] Appl. No.: 436,637

[22] Filed: Nov. 15, 1989

[51] Int. Cl.[5] ..... A47G 29/00

[52] U.S. Cl. ..... 248/125; 248/293

[58] Field of Search ..... 248/125, 124, 295.1, 248/293, 161, 408, 354.5; 211/196, 1.3, 205, 119.01

[56] References Cited

U.S. PATENT DOCUMENTS

| | | | |
|---|---|---|---|
| 1,587,676 | 6/1926 | Patterson | 211/1.3 |
| 2,722,970 | 11/1955 | Stechmann | 248/408 X |
| 3,145,965 | 8/1964 | Stein | 248/408 |
| 4,102,065 | 7/1978 | Selden | 248/125 X |
| 4,239,169 | 12/1980 | DeSantis | 248/125 X |
| 4,725,027 | 2/1988 | Bekanich | 248/125 |
| 4,807,837 | 2/1989 | Gawlik et al. | 248/125 |

*Primary Examiner*—Alvin C. Chin-Shue

*Attorney, Agent, or Firm*—Fleit, Jacobson, Cohn, Price, Holman & Stern

[57] ABSTRACT

A valet for supporting articles of clothing and related accessories in a convenient and readily accessible position to enable such articles to be readily at hand when dressing or for supporting such articles temporarily when not in use. The valet includes a stand having a vertically disposed tubular standard telescopically receiving a post with unique latch structures to retain the post in extended position and to prevent it from being totally extracted from the tubular standard which receives it when in collapsed position. The upper end of the post is provided with a laterally extending support arm that can be pivoted from a vertical stored position to a horizontal operative position and securely retained in this position for supporting a plurality of clothes hangers or other articles. The support arm is pivotal and slidable for nesting within a lateral recess in the side of the post to enable the post to be completely telescoped into the tubular standard.

1 Claim, 1 Drawing Sheet

COLLAPSIBLE VALET

BACKGROUND OF THE INVENTION

1. Field of the Invention

The present invention generally relates to a valet for supporting articles of clothing and related accessories in a convenient and readily accessible position to enable such articles to be readily at hand when dressing or for supporting such articles temporarily when not in use. The valet includes a stand having a vertically disposed tubular standard telescopically receiving a post with unique latch structures to retain the post in extended position and to prevent it from being totally extracted from the tubular standard which receives it when in collapsed position. The upper end of the post is provided with a laterally extending support arm that can be pivoted from a vertical stored position to a horizontal operative position and securely retained in this position for supporting a plurality of clothes hangers or other articles. The support arm is pivotal and slidable for nesting within a lateral recess in the side of the post to enable the post to be completely telescoped into the tubular standard.

2. Information Disclosure Statement

Valets of various types and configurations have been provided by which articles of clothing and accessories are supported in a position for ready access. Such devices usually include a supporting stand having an upwardly extending component with various arrangements being provided to support articles of clothing and accessories therefrom. Such known devices are usually rigid structures, occupy considerable space and frequently become unbalanced when articles of clothing are supported from the upper end of the device. Also, various types of telescoping stands for various purposes are well-known. The following U.S. patents are exemplary of the state of the art in this field of endeavor.

483,275
2,483,242
2,654,484
2,854,303
2,957,187

None of the above patents disclose the specific structural details of the present invention which provide a balanced, free-standing, collapsible valet in accordance with the disclosure in this application.

SUMMARY OF THE INVENTION

An object of the present invention is to provide a valet for articles of clothing, accessories and the like which is constructed in a manner to enable it to be collapsible so that it will occupy relatively little space with the valet including a centrally disposed vertically extending supporting structure to provide a balanced supporting arrangement.

Another object of the invention is to provide a collapsible valet in accordance with the preceding object which is free-standing and provided with relatively short laterally extending legs forming a base for a vertically disposed tubular standard which telescopically receives an elongated vertically extendable and retractable post having a pivotally and slidably supported support arm at the upper end thereof which, in extended position, is disposed generally horizontally and laterally from the upper end portion of the post with a unique structure being provided to retain the support arm in extended position and to enable it to pivot to be received totally within a lateral recess in the side surface of the post to enable the post to completely telescope into the tubular standard.

A further object of the invention is to provide a collapsible valet in accordance with the preceding objects in which a unique latch structure is provided to retain the vertically extendable and retractable post in vertically extended position and also unique latch means to prevent the post from being completely removed upwardly from the upper end of the tubular standard.

Still another object of the present invention is to provide a collapsible valet which is balanced, free-standing, capable of supporting several articles of clothing and accessories in an effective and readily accessible manner, capable of use in various areas including but not limited to dressing rooms, offices, hotel and motel rooms as well as in homes and which is constructed to occupy very small areas of floor space.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 5:
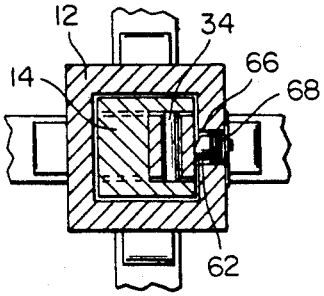
FIG. 5 is a transverse, sectional view taken substantially upon a plane passing along section line 5—5 on FIG. 3 illustrating further structural details of the latch structure for precluding movement of the post vertically out of the top end of the tubular standard.

Referring now specifically to the drawings, the collapsible valet of the present invention is generally designated by reference numeral 10 which includes a vertically elongated tubular standard 12 forming the bottom portion of the valet and an elongated, vertically extending post 14 forming the upper portion thereof. The lower end of the tubular standard 12 is provided with a plurality of laterally extending support members 16 having downwardly offset outer end portions 18 forming supporting feet for the tubular standard 12. As illustrated in the drawings, the tubular standard 12 is of square configuration with equal width side walls thus defining a hollow or tubular interior area 20 with the opposite side walls of the standard 12 being connected to the laterally extending support members 16 by gusset-type braces 22 or the like secured in place by screw threaded fasteners 24 or the like with the supporting feet 18 being symetrically related to the tubular standard 12 and extending laterally therefrom an equal distance to each side of the standard 12. The upper end of the standard 12 is provided with a peripheral top edge member 26 secured to the upper end of the standard 12 by suitable fasteners, by adhesive bonding or the like. The transverse cross-sectional configuration of the standard 12 is substantially square with both the exterior and tubular interior 20 also being square with the tubular interior 20 closely telescopically receiving the post 14 which has a corresponding cross-sectional configuration as illustrated in FIG. 5.

Figure 1:
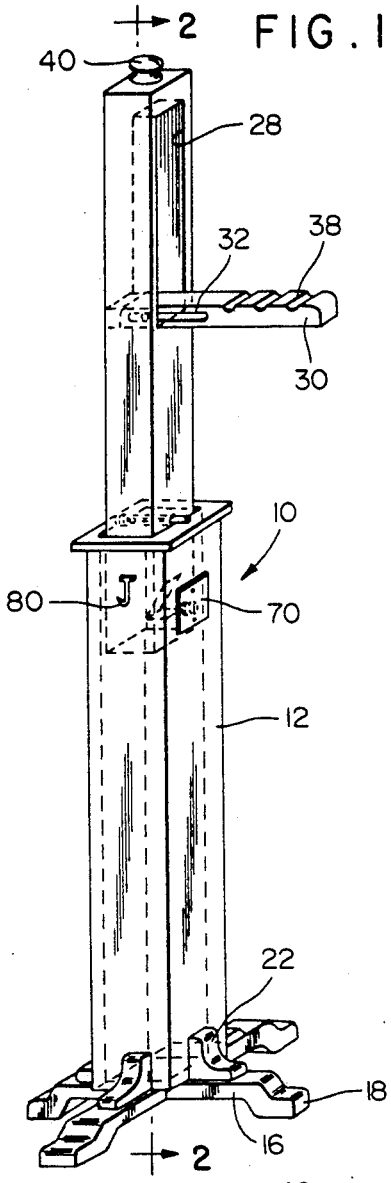
FIG. 1 is a perspective view of the collapsible valet of the present invention in position for use.
Figure 2:
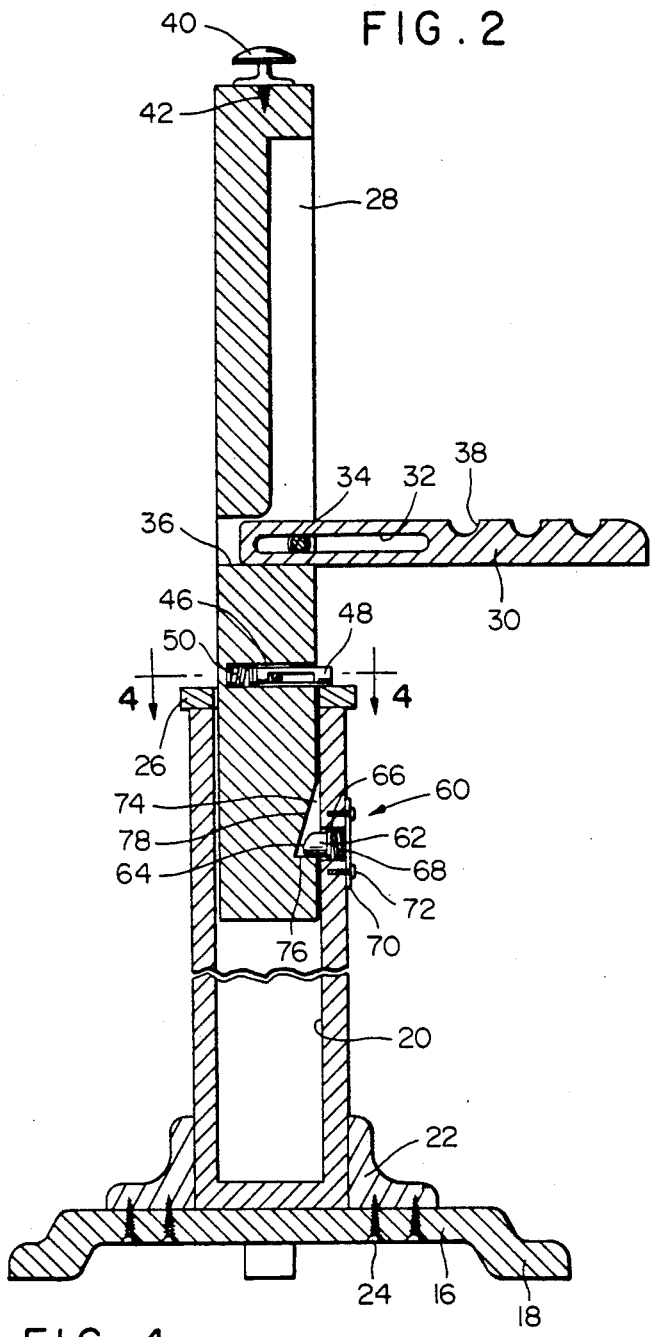
FIG. 2 is a vertical, sectional view, on an enlarged scale, taken substantially upon a plane passing along section line 2—2 with portions broken away illustrating the specific structural details of the valet.
Figure 3:
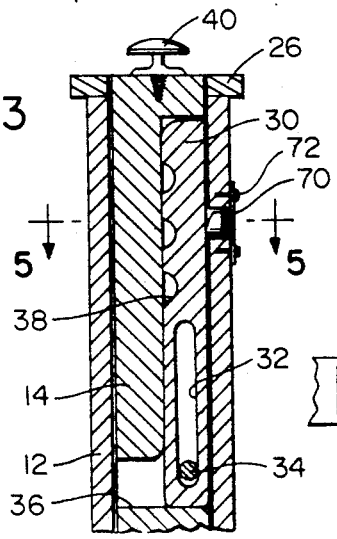
FIG. 3 is a fragmental, sectional view of the upper end portion of the extendable post and its relationship to the upper end of the standard when the post is in collapsed position.

The upper end portion of the post 14 includes a vertically elongated laterally opening vertical groove or recess 28 which completely receives a support arm 30 when the support arm 30 is in collapsed condition as illustrated in FIG. 3. The support arm or rod 30 is provided with a longitudinally extending slot 32 in one end portion thereof which receives a transverse pin or dowel 34 that extends across the groove 28 at a point adjacent the bottom end of the groove as illustrated in FIG. 2 with the pin being disposed adjacent the external surface of the post 14 and slidably and pivotally mounting the support arm 30 to the post. In alignment with the pin 34, the post 14 is provided with a lateral opening 36 which extends from the inner wall of the groove 28 completely through to the opposite surface of the post 14 as illustrated in FIG. 2. This structure enables the support arm 30 to fall or be pivoted from a collapsed position completely within the groove 28 as illustrated in FIG. 3 to the position illustrated in FIG. 2 in which the arm 30 extends laterally from the post 14. This movement is permitted only when the post 14 is telescoped upwardly to its extended position. When the post has been moved to its extended position, the upper end of the support arm 30 will fall or can be pivoted outwardly until the arm 30 reaches a generally horizontal position after which the arm 30 can be moved axially to insert the end thereof into or through the opening 36 as illustrated in FIG. 2 thereby securely retaining the support arm 30 in the horizontal operative position. The upper surface of the arm 30, when in horizontal position, includes a plurality of notches or grooves 38 which effectively support a plurality of articles of clothing, clothes hangers, supporting straps, accessories and the like.

Figure 4:
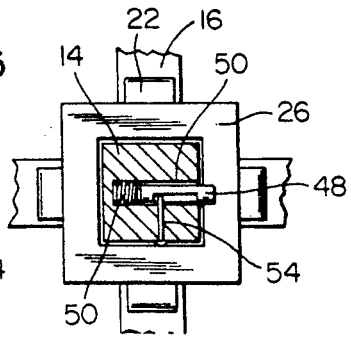
FIG. 4 is a transverse, sectional view taken substantially upon a plane passing along section line 4—4 on FIG. 2 illustrating specific structural details of the latch for retaining the post in extended position.

The upper end of the post is provided with a knob or finial 40 attached thereto by a screw threaded fastener 42 or the like which provides a decorative upper end to the post and also a handle for lifting the post vertically upwardly. A latch structure generally designated by reference numeral 44 is provided in the post to retain it in vertically extended position as illustrated in FIGS. 2 and 4. The latch structure 44 includes a horizontally extending recess or bore 46 extending inwardly from one side surface of the post, preferably the same side surface which has the groove 28 therein. Axially slidably mounted in the bore 46 is a stop pin 48. The stop pin 48 is movably mounted in the outer end portion of the bore 46 with a coil compression spring 50 being disposed between the inner end of the pin 48 and the bottom of the bore 46 thus spring biasing the pin 48 outwardly. The side wall of the pin 48 is provided with a longitudinal groove or recess 52 therein to receive a retaining pin 54 which extends inwardly from the surface of the post 14 with the inner end thereof disposed in the groove 52 to prevent the pin 48 from completely exiting from the bore 46 with the length of the groove 52 being sufficient to enable the outer end of the pin 48 to engage the upper surface of the upper edge member 26 on the tubular standard 12 as illustrated in FIGS. 2 and 4 thus retaining the post 14 in extended position with the outer end of the pin 48 being engageable by the thumb or finger and pushed inwardly to enable the post 14 to be lowered into the interior of the standard 12.

To limit the upward movement of the post when it is moved upwardly to extended position, an upward movement limit latch generally designated by reference numeral 60 is provided on the tubular standard and includes a pin 62 having a slanted or inclined inner end 64. The pin 62 is slidable in an aperture 66 in the tubular standard and a compression coil spring 68 engages the outer end of the pin 62 in order to spring bias it inwardly. A cover plate 70 overlies the spring 68 and covers the aperture 66 with the cover plate 70 being secured in place by screw threaded fasteners 72. The corresponding side wall of the post 14 which faces the opening 66 is provided with a groove or recess 74 having a horizontally disposed lower edge 76 and a slanted or inclined inner wall 78 which cooperates with the inner end 64 of the spring biased pin 62 which is in alignment with the recess or groove 74. As the post is moved upwardly, the inclined or slanted end 64 of the pin 62 will move into the recess 64 as it will follow the inclination of the inner wall 78 of the groove 74 so that the straight horizontal lower end 76 of the recess 74 will engage the bottom surface of the pin 62 thereby limiting the upward movement of the post 14 to a position with the spring loaded pin 48 just above the top edge 26 of the standard 12. However, when the pin 48 is pushed inwardly to move the post downwardly, the inclined inner wall 78 will cam the pin 62 outwardly against the spring 68 thus enabling the post to move downwardly to a collapsed position. Thus, the post is supported in a stable, extended position and it cannot be pulled completely out of the tubular standard.

The tubular standard is also provided with stationarily supported hooks 80 adjacent the upper end thereof with the hooks being on at least three sides of the tubular standard and optionally on the fourth side thereof having the plate 70 mounted thereon thereby providing supporting hooks for articles of clothing accessories and the like.

The collapsible valet is especially useful in homes but is also useful in commercial establishments, dressing rooms, offices, hotel and motel rooms and the like since it is collapsible to a relatively small size and will occupy very little floor space. It will effectively hold a plurality of garments or articles of clothing as well as various often used accessories. The support member or foot 16 which extends to the front of the valet (opposite to arm 30) is shorter thereby eliminating or reducing the possibility of tripping over the foot as an obstruction but this does not alter the supporting characteristics of the other feet which support the cantilevered support arm 30. While dimensions may vary, when collapsed, the valet may be approximately 32" in height while extended, it may be at least approximately 50" in height with it being well balanced and provided with a low profile and a low center of gravity with the components preferably being contructed of wood or simulated wood to provide not only an attractive valet but one which is quite effective for supporting a plurality of garments and accessories to reduce clutter and maintain such items in readily accessible position.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A collapsible valet comprising a tubular upstanding standard, support means at the lower end of the standard for engaging a supporting surface, a vertically extendable and retractable post telescoped into the tubular standard and extending from the upper end thereof, mans on said post engaging the standard to hold the post in extended position, means interconnecting the standard and post to limit the upward movement of the post towards extended position to prevent the post from exiting from the upper end of the tubular standard, and collapsible means adjacent the under end of the post and extending laterally therefrom when in operative position to support articles of clothing, accessories and the like therefrom, said means to hold the post in extended position including a spring biased radial pin mounted in a radial bore in said post and movable from a position flush with the post when the post in interiorly of the tubular standard and moving outwardly into overlying supporting engagement with the upper end of the tubular standard when the pin moves above the upper end of the standard, wherein said means limiting the upward movement of the post including a spring biased pin mounted adjacent the upper end of the tubular standard but spaced below the upper end thereof, said pin having an inclined inner end, said post including a recess having a substantially horizontal bottom wall and an inclined inner wall extending from the inner edge of the bottom wall to the outer surface of the post at the upper end of the recess with the pin having a corresponding inclination on the inner end thereof whereby the inner end of the spring biased pin will enter the recess and engage the bottom wall thereof to limit upward movement of the post and present the post from being removed from the tubular standard, said means adjacent the upper end of the post to support articles of clothing including an elongated support arm, said post including a laterally opening groove receiving the arm when the arm is in collapsed, vertical position, means pivotally and slidably supporting one end of the arm from the post for movement of the arm from a vertically collapsed position to a horizontal, laterally extending position, said means supporting the arm from the post including a transverse pin extending across the groove in the post, said arm including a longitudinal slot adjacent one end thereof receiving said pin, said post including a lateral opening extending therethrough in communication with the groove and in alignment with the pin to receive one end of the arm when pivoted to horizontal position and moved axially into the opening thereby supporting the arm securely in horizontal position, said transverse pin being adjacent the lower end of the groove with the support arm extending upwardly therefrom when the support arm is positioned in the groove whereby the upper end of the support arm can pivot downwardly and outwardly by gravity when the post is extended with the arm being stopped in horizontal position by the pin and bottom wall of the groove to enable inward movement of the horizontal arm until the inner end thereof enters the opening to securely retain the arm in position and shorten the length thereof which is cantilever supported by the post and tubular standard, said support means at the lower end of the standard including laterally extending support members extending radially from the tubular standard in circumferentially spaced relation, one of said laterally extending members being positioned in alignment with the support arm when the support arm is in horizontal position, another of said laterally extending support members extending radially in opposed relation to the support arm when the support arm is in horizontal position, the laterally extending support member extending oppositely from the support arm being shorter than said one laterally extending support member thereby reducing the floor area occupied by the collapsible valet in the area thereof opposite said one laterally extending support arm thus enabling articles of clothing to be supported on the support arm in overlying relation to said one laterally extending support member thereby enabling the collapsible valet to be positioned adjacent a wall surface and also reduce hazards to persons approaching the collapsible valet from the area having the shorter support member extending therefrom, said tubular standard and post being of square, transverse, cross-sectional configuration, the angle of inclination of the recess in the post and the inner end of the spring biased pin enabling the post to be telescoped into the tubular standard without manually releasing the pin with the spring biased pin providing frictional engagement with the post, said support arm being moved into the groove by upward pivoting movement as the post telescopes into the tubular standard when the support arm has been moved radially outwardly to enable the transverse pin to serve as a pivot point for the supporting arm.

* * * * *